US008113776B2

(12) United States Patent
June et al.

(10) Patent No.: US 8,113,776 B2
(45) Date of Patent: Feb. 14, 2012

(54) REDUCED-IMPEDANCE COOLING SYSTEM WITH VARIABLE PITCH BLADE AND HOT-SWAPPABLE SPARE

(75) Inventors: Michael Sean June, Raleigh, NC (US); Michael Sven Miller, Raleigh, NC (US); Paul Andrew Wormsbecher, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 979 days.

(21) Appl. No.: 12/100,906

(22) Filed: Apr. 10, 2008

(65) Prior Publication Data

US 2009/0257872 A1 Oct. 15, 2009

(51) Int. Cl.
*F03B 3/12* (2006.01)

(52) U.S. Cl. ..... 416/1; 416/61; 416/130; 416/147; 415/30; 415/61; 415/66

(58) Field of Classification Search ..... 415/30, 415/66, 61; 416/1, 61, 130, 147
See application file for complete search history.

(56) References Cited

U.S. PATENT DOCUMENTS

| | | | | |
|---|---|---|---|---|
| 3,932,054 | A | 1/1976 | McKelvey | |
| 6,101,459 | A | 8/2000 | Tavallaei et al. | |
| 6,253,716 | B1 | 7/2001 | Palmer et al. | |
| 6,386,826 | B1 | 5/2002 | Jacob | |
| 6,729,844 | B2 | 5/2004 | Bettencourt | |
| 6,767,186 | B2 * | 7/2004 | Olesiewicz | 416/136 |
| 6,932,696 | B2 | 8/2005 | Schwartz et al. | |
| 6,972,956 | B2 * | 12/2005 | Franz et al. | 415/66 |
| 7,054,156 | B2 * | 5/2006 | Espinoza-Ibarra et al. | 416/1 |
| 7,184,268 | B2 * | 2/2007 | Espinoza-Ibarra et al. | 415/191 |
| 2007/0081888 | A1 | 4/2007 | Harrison | |

FOREIGN PATENT DOCUMENTS

JP 2003-301797 10/2003

OTHER PUBLICATIONS

Multiple Fan Systems-Fans In Series And Parallel, www.greenheck.com; printed Jan. 14, 2008; 6 pages.

* cited by examiner

*Primary Examiner* — Igor Kershteyn
(74) *Attorney, Agent, or Firm* — Cynthia G. Seal; Jeffrey L. Streets

(57) ABSTRACT

A method of operating variable pitch fans in series to cool an operating computer system. The method comprises running a first variable pitch fan with blades positioned at an operational pitch to induce airflow through the computer system and through a second variable pitch fan disposed in series with the first fan, and, simultaneously, not running the second variable pitch fan with blades positioned for minimal impedance to the airflow. In response to detecting a failure condition of the first fan, the method includes running the second fan with blades positioned at an operational pitch to induce airflow through the computer system and through the first fan, and, simultaneously, not running the first fan with blades positioned for minimal impedance to the airflow. Preferably, the method includes locking the rotor of a fan that is not running, and locking the blades of the non-running fan in a minimal impedance position.

20 Claims, 2 Drawing Sheets

REDUCED-IMPEDANCE COOLING SYSTEM WITH VARIABLE PITCH BLADE AND HOT-SWAPPABLE SPARE

BACKGROUND OF THE INVENTION

1. Field of the Invention

The present invention relates to cooling computers and other electronic systems.

2. Background of the Related Art

One aspect of thermally managing computer systems involves properly cooling computer equipment to ensure the reliability and proper performance of that equipment. Properly cooling computer equipment typically requires generating airflow through computer equipment to remove heat generated by the computer equipment and maintain the temperature of various components within a suitable operating range. Innovations in computer technology have led to an increase in the power consumption and power density of computer equipment, along with increase in the airflow rates that are required to cool the computer equipment. As a result, the cost of operating computer equipment is also increasing. For example, it is now common for the costs associated with powering a server during the server's lifetime to exceed the original purchase price of the server. Total cost of ownership of computer equipment is an important consideration in the design of computer systems, and minimizing the total cost of ownership is therefore desirable.

Various fan configurations are available for cooling computer systems. Current systems and methods include the use of redundant, serially-arranged cooling fans. For example, US Patent Application 20070081888 to Harrison discloses the simultaneous use of two serially-arranged fans with variable-pitch blades that collectively induce airflow through the computer at rates sufficient to cool the computer. In the event of a failure of the primary fan, the primary fan blades move from an oblique position to a coaxial position, which aligns the blades with the airflow to present lower impedance as seen by the secondary fan. Harrison further discloses a control system to sense failure of the primary fan and increase the speed of the remaining secondary fan accordingly, in order to ensure that a minimum airflow requirement is met until the defective primary fan can be replaced.

Each individual fan in a typical set of serially-arranged fans will contribute to the overall airflow. Typically, each individual fan is unable to supply the cooling needs of the system as a whole, particularly at higher loads. Thus, multiple fans are operated simultaneously to achieve the airflow necessary to cool the system.

The problem with operating multiple fans is that each fan presents airflow impedance to the other serially-arranged fans. This impedance represents a loss component that substantially undercuts the efficiency of the cooling system. Even though Harrison teaches the use of variable-pitch fan blades having the capacity to be moved to a lower-impedance position, the pitch of a fan is only moved to the lower-impedance position in the event of a failure of that fan. During normal operation, however, each of the multiple fans is operated in the higher-impedance position in order to provide sufficient airflow to cool the system. Thus, no appreciable efficiency benefit directly results from the presence of variable-pitch fans in the configuration taught by Harrison.

BRIEF SUMMARY OF THE INVENTION

One embodiment of the present invention provides a method of operating variable pitch fans in series to cool an operating computer system. The method comprises running a first variable pitch fan with blades positioned at an operational pitch to induce airflow through the computer system and through a second variable pitch fan disposed in series with the first fan, and, simultaneously, not running the second variable pitch fan with blades positioned for minimal impedance to the airflow. In response to detecting a failure condition of the first fan, the method includes running the second fan with blades positioned at an operational pitch to induce airflow through the computer system and through the first fan, and, simultaneously, not running the first variable pitch fan with blades positioned for minimal impedance to the airflow. Preferably, the method includes locking the rotor of a fan that is not running, and locking the blades of the non-running fan in a minimal impedance position.

Another embodiment of the present invention provides a method of operating a computer system disposed in a chassis having a plurality of fan pairs, each fan pair including first and second variable pitch fans disposed in series. The first variable pitch fan of each fan pair is run with blades positioned at an operational pitch to induce airflow through the computer system and through the second variable pitch fan of the fan pair, and, simultaneously, the second variable pitch fan of each fan pair is turned off with blades positioned for minimal impedance to the airflow. The first fan of each fan pair is monitored for a failure condition. In response to detecting a failure condition in the first fan of at least one fan pair, the second fan of the at least one fan pair is run with blades positioned at an operational pitch to induce airflow through the computer system and through the first fan of the at least one fan pair, and, simultaneously, the first fan of the at least one fan pair is turned off with blades positioned for minimal impedance to the airflow.

DETAILED DESCRIPTION OF THE INVENTION

Figure 1:
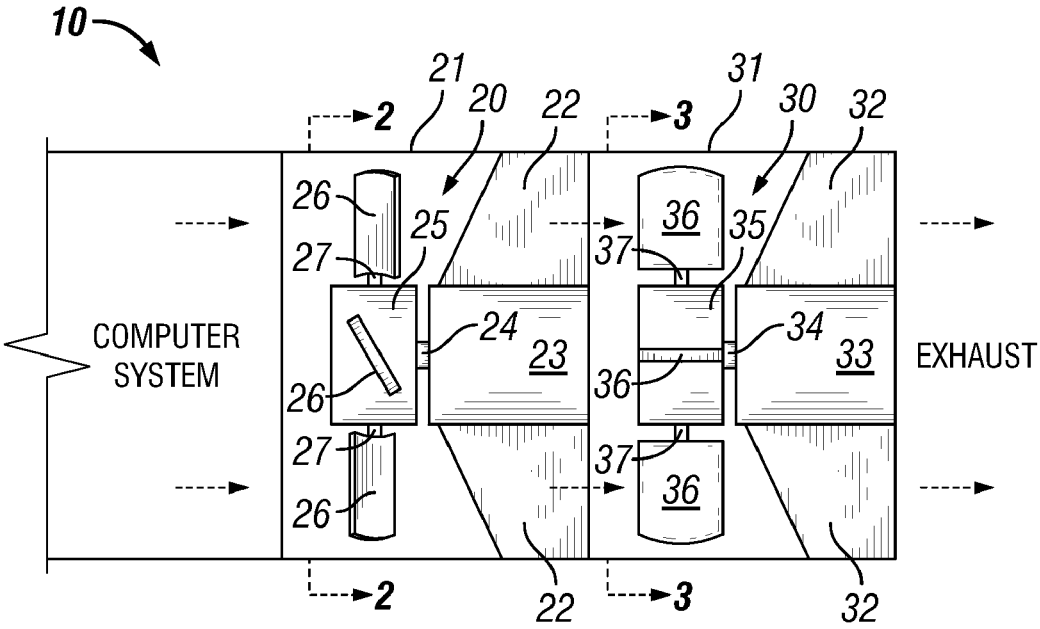
FIG. 1 is a schematic side view of two fans with adjustable-pitch blades arranged in series.

One embodiment of the present invention provides a method of operating variable pitch fans in series to cool an operating computer system. The method comprises running a first variable pitch fan with blades positioned at an operational pitch to induce airflow through the computer system and through a second variable pitch fan disposed in series with the first fan, and, simultaneously, not running the second variable pitch fan with blades positioned for minimal impedance to the airflow. In response to detecting a failure condition of the first fan, the method includes running the second fan with blades positioned at an operational pitch to induce airflow through the computer system and through the first fan, and, simultaneously, not running the first variable pitch fan with blades positioned for minimal impedance to the airflow. Accordingly, there is normally only one fan running and the other series fan is turned off and positioned for minimal impedance to airflow. Running the serially-arranged, variable pitch fans in this manner minimizes any loss of efficiency in the fan system, while also providing redundant fans that can continue to cool a computer system in the event of a fan failure.

Preferably, the method includes locking the rotor of a fan that is not running, locking the blades of the non-running fan in the minimal impedance position, or both. Each of these optional steps further reduces or minimizes the airflow impedance of the non-running fan.

In another embodiment, each of the fans can individually generate airflow, through the computer system and through the second fan with blades positioned for minimal impedance, that is sufficient to cool the computer system across a full range of anticipated workloads. Accordingly, the fans are fully redundant and the failure of one of the fans does not require any throttling or shut down of the computer system. Furthermore, since it is only necessary and desirable to run one fan at a time, the power consumption of the series fans is substantially the same as the power consumption of a single fan.

In yet another embodiment, the performance of the running fan is continuously monitored to detect failure conditions. Such performance monitoring may include predictive failure analysis. A failure condition may be characterized in many ways, for example when the actual fan speed that falls below a desired fan speed by more than a setpoint amount. Although some fans are designed to run at a constant speed and other are designed to run at various speeds, such as various different incremental speeds, the present example of a failure condition only occurs when the actual speed deviates from the intended speed that the fan. Alternatively, a failure condition could be detected by a change in the voltage or current to the fan motor.

In a further embodiment, the method may include occasionally running both of the fans with blades positioned at an operational pitch to identify whether either of the first and second fans is experiencing a failure condition. The benefit of this step is to test whether the non-running or "backup" fan is in good working order so that it can reliably take over if needed.

In an alternative embodiment, the method may include occasionally alternating which of the series fans is run with blades positioned at an operational pitch to induce airflow and which of the series fans is not run with blades positioned for minimal impedance to the airflow. In this manner, it is possible to test whether the non-running or "backup" fan is in good working order without operating both fans simultaneously. Furthermore, this step may provide more even wear on the two fans that disposed in series, and lengthen the time to failure.

In a still further embodiment, each of the variable pitch fans may allow incremental variation of the blade pitch, such that the operational pitch of blades on the running fan may be varied to optimize airflow efficiency at multiple fan speeds. Accordingly, this embodiment requires a variable pitch fans that supports multiple operational pitches, rather than simply an operational pitch and a minimum impedance pitch.

In yet another embodiment, the method includes, in response to detecting a failure condition, sending an alert signal to indicate that the first fan has failed. For example, an alert signal may be audible, visible or electronic, such as a beep, flashing light or alarm display, or a electronic communication to a workstation designated for a system administrator, respectively. Still further, an alert signal may be communicated to other hardware or software components for taking further action. Preferably, if the first fan has a failure condition, the method will further include replacing the first fan with a third variable pitch fan while the second fan is running. So long as the second fan is running, the third variable pitch fan remains turned off with blades positioned for minimal impedance to the airflow. Alternatively, the third fan may be temporarily tested or allowed to run while the second fan shut down with blades set to the minimal impedance position. The second and third fans are operated in the same manner as the original first and second fans. Most preferably, the first fan is replaced with the third fan without shutting down the computer system.

Another embodiment of the present invention provides a method of operating a computer system disposed in a chassis having a plurality of fan pairs, each fan pair including first and second variable pitch fans disposed in series. The first variable pitch fan of each fan pair is run with blades positioned at an operational pitch to induce airflow through the computer system and through the second variable pitch fan of the fan pair, and, simultaneously, the second variable pitch fan of each fan pair is turned off with blades positioned for minimal impedance to the airflow. The first fan of each fan pair is monitored for a failure condition. In response to detecting a failure condition in the first fan of at least one fan pair, the second fan of the at least one fan pair is run with blades positioned at an operational pitch to induce airflow through the computer system and through the first fan of the at least one fan pair, and, simultaneously, the first fan of the at least one fan pair is turned off with blades positioned for minimal impedance to the airflow. It should be recognized that each fan pair may be operated according to any one or more of the foregoing embodiments as described for a first and second fan disposed in series.

FIG. 1 is a schematic side view of an assembly 10 comprising two fans 20, 30 with variable-pitch blades arranged in series. A first variable pitch fan 20 has a housing 21 and a low airflow impedance support structure 22 for centrally supporting a fan motor 23. The fan motor 23 is electrically connected to a source of electricity (not shown) and may utilize electrical current to turn a rotor and shaft 24. A hub 25 couples a plurality of fan blades 26 to the end of the shaft 24 so that the blades are rotated about an axial center of the motor 23. In order to vary the pitch of the blades 26, each blade 26 has an individual blade shaft 27 that is received in the hub 25. Various electromechanical designs are available for causing rotation of each blade shaft 27 so that the pitch of each blade 26 is varied. For example, the shaft 24 may include coaxial members, wherein the extension of one member relative to the other member causes rotation of each blade shaft 27. By maintaining this relative extension, the blade pitch can be maintained and/or changed even while the motor 23 is run to cause the rotor and shaft 24 to rotate. Other electromechanical designs for a variable pitch fans will be recognized by those having ordinary skill in the art.

A second variable pitch fan 30 is disposed in series with the first fan 20 such that the air flow induced by one fan flows through the other fan. As shown in FIG. 1, the first fan 20 is running with blades in an operational pitch and the second fan 30 is not running and has its blades set parallel to the axis of the fan. The second fan 30 has a housing 31 and a low airflow impedance support structure 32 for centrally supporting a fan motor 33. The fan motor 33 is electrically connected to a source of electricity (not shown) and may utilize electrical current to turn a rotor and shaft 34. A hub 35 couples a plurality of fan blades 36 to the end of the shaft 34 so that the blades are rotated about an axial center of the motor 33. In order to vary the pitch of the blades 36, each blade 36 has an individual blade shaft 37 that is received in the hub 35. As discussed above, various electromechanical designs are available for causing rotation of each blade shaft 37 so that the pitch of each blade 36 is varied. The present invention is not directed to the design of variable pitch fans, and the invention is not limited to any particular design of a variable pitch fan.

The two series-arranged fans 20, 30 of assembly 10 are typically positioned in a chassis that includes a computer system. Specifically, the computer system may be disposed on either the intake or outlet end of the assembly 10, but it most commonly disposed on the intake end such that air is drawn through the computer system.

Figure 2:
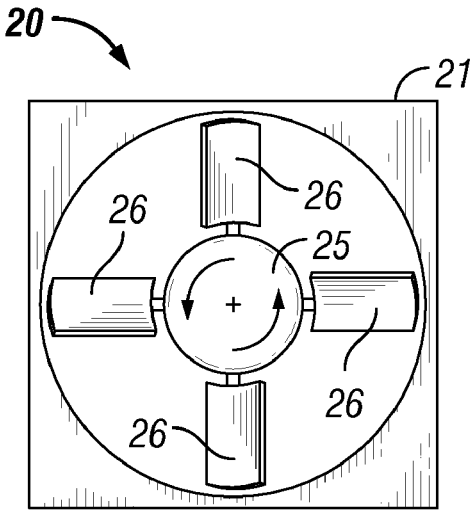
FIG. 2 is a front view of a first fan having blades positioned at an operational pitch.

FIG. 2 is a front view of the first fan 20 having blades 26 positioned at an operational pitch. As shown, counter-clockwise rotation or the blades 26 draws air into the fan 20.

Figure 3:
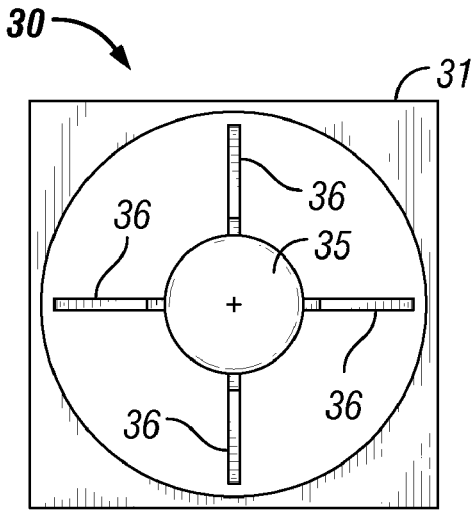
FIG. 3 is a front view of a second fan having blades positioned for minimal airflow impedance.

FIG. 3 is a front view of the second fan 30 having blades 36 positioned for minimal airflow impedance. As shown from the front, the blades 36 leave the air flow passage substantially open with substantially only the thickness of the blades 36 providing any impedance to air flow. Optionally, rotor may be locked in a position where the blades 36 are aligned with the support structure 32 to further minimize the overall airflow impedance of the fan. It should be recognized that, in accordance with various embodiments of the present invention, the second fan 30 may be run with blades at an operational pitch (as shown in FIG. 2) and the first fan 20 may be turned off with blades in a minimal impedance pitch (as shown in FIG. 3).

Figure 4:
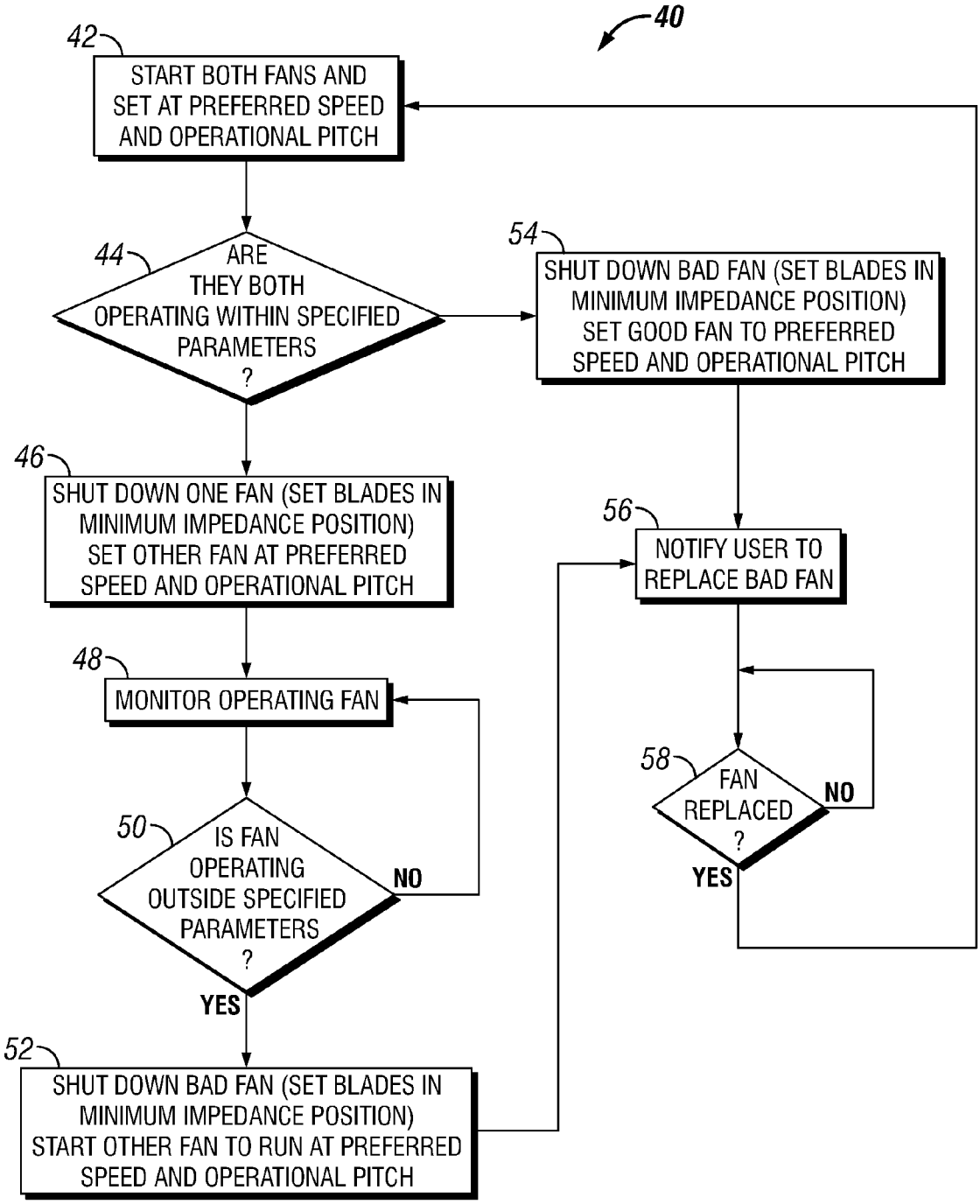
FIG. 4 is a flow chart detailing a method for operating two fans with adjustable-pitch blades arranged in series.

FIG. 4 is a flow chart detailing a method 40 for operating two fans with adjustable-pitch blades arranged in series. This is just one exemplary method of the present invention. Those having ordinary skill in the art will, after gaining an appreciation of the invention as described herein, recognize other variations of the method.

In step 42, both of the serially-arranged fans are started (run) at a preferred rotational speed and with the blades at a preferred operational pitch. The rotational speed may selected on the basis of the cooling requirements of the computer system at its present workload or it may be selected for the purpose of analyzing the fan performance. In step 44, it is determined whether both fans are operating within one or more specified parameters. For example, the specified parameter may include a minimum achievable fan speed or current/voltage limitations.

If both fans are determined to be operating properly in step 44, then in step 46 one of the two fans is shut down (turned off) and its blades are set in a minimum impedance position (See FIG. 3). Also in step 46, the other of the two fans is run with its blades at an operational pitch (See FIG. 2). In step 48, the performance of the operating (running) fan is monitored. If, in step 50, fan is operating within specified parameters (i.e., no failure condition), then the operating fan continues to be monitored. However, it the fan is operating outside of the specified parameters, then the method continues to step 52. In step 52, the poorly operating fan is shut down (turned off) with its blades set in the minimum impedance position (See FIG. 3) and the other fan is started (run) with blades set at an operational pitch (See FIG. 2). Next, a fan controller or other components of the computer system notifies a user, in step 56, that the particular fan has failed and should be replaced. Once the system detects that the fan has in fact been replaced, in step 58, then the method returns to step 42.

Returning to step 44, if it is determined that both fans are not operating within specified parameters, then, in step 54, the bad fan is shut down (turned off) with its blades set in the minimum impedance position (See FIG. 3) and the other fan is run with blades set at an operational pitch (See FIG. 2). After step 54, the user is also notified about the bad fan and the need to replace the fan.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A method, comprising:

operating a computer system;

running a first variable pitch fan with blades positioned at an operational pitch to induce airflow through the computer system and through a second variable pitch fan disposed in series with the first fan, and, simultaneously, not running the second variable pitch fan with blades positioned for minimal impedance to the airflow, detecting a failure condition of the running fan; and then in response to detecting the failure condition, running the second fan with blades positioned at an operational pitch to induce airflow through the computer system and through the first fan, and, simultaneously, not running the first variable pitch fan with blades positioned for minimal impedance to the airflow.

2. The method of claim 1, wherein running the first fan generates a desired airflow rate through the computer system and through the second fan with blades positioned for minimal impedance.

3. The method of claim 1, further comprising:

locking the rotor of the second fan against rotation when the second fan is not running.

4. The method of claim 1, further comprising:

locking the rotor of the first fan against rotation when the first fan is not running.

5. The method of claim 1, further comprising:

locking the blades of the second fan in the minimal impedance position when the second fan is not running.

6. The method of claim 1, further comprising:

locking the blades of the first fan in the minimal impedance position when the first fan is not running.

7. The method of claim 1, further comprising:

replacing the first fan with a third variable pitch fan while the second fan is running; and not running the third variable pitch fan with blades positioned for minimal impedance to the airflow.

8. The method of claim 7, wherein the first fan is replaced with the third fan without shutting down the computer system.

9. The method of claim 1, further comprising:

occasionally running both of the fans with blades positioned at an operational pitch to identify whether either of the first and second fans is experiencing a failure condition.

10. The method of claim 1, further comprising:

occasionally alternating which of the series fans is run with blades positioned at an operational pitch to induce airflow and which of the series fans is not run with blades positioned for minimal impedance to the airflow.

11. The method of claim 1, wherein the failure condition is an actual fan speed that falls below a desired fan speed by more than a setpoint amount.

12. The method of claim 1, further comprising:

in response to detecting the failure condition, sending an alert signal to indicate that the first fan has failed.

13. The method of claim 1, further comprising:

continuously monitoring performance of the running fan.

14. The method of claim 13, wherein the step of continuously monitoring performance of the running fan includes predictive failure analysis.

15. The method of claim 1, wherein the power consumption of the series fans is substantially the same as the power consumption of a single fan.

16. The method of claim 1, further comprising:

adjusting the operational pitch of blades on the running fan to optimize airflow efficiency at multiple fan speeds.

17. A method, comprising:

operating a computer system disposed in a chassis having a plurality of fan pairs, each fan pair including first and second variable pitch fans disposed in series;

running the first variable pitch fan of each fan pair with blades positioned at an operational pitch to induce airflow through the computer system and through the second variable pitch fan of the fan pair, and, simultaneously, not running the second variable pitch fan of each fan pair with blades positioned for minimal impedance to the airflow, monitoring the first fan of each fan pair for a failure condition;

detecting a failure condition in the first fan of at least one fan pair; and then in response to detecting the failure condition, running the second fan of the at least one fan pair with blades positioned at an operational pitch to induce airflow through the computer system and through the first fan of the at least one fan pair, and, simultaneously, not running the first fan of the at least one fan pair with blades positioned for minimal impedance to the airflow.

18. The method of claim 17, further comprising:

preventing rotation of the rotors of the each fan that is not running.

19. The method of claim 17, further comprising:

locking the blades of each fan that is not running to secure the blades in the minimal impedance position.

20. The method of claim 17, further comprising:

in response to detecting the failure condition, sending an alert signal identifying the fan with the failure condition.

* * * * *